US005529297A

United States Patent [19]

Sawdon

[11] Patent Number: 5,529,297

[45] Date of Patent: Jun. 25, 1996

[54] CLAMP HAVING INTERNAL SNAP-FIT ATTACHMENTS

[75] Inventor: Edwin G. Sawdon, St. Clair, Mich.

[73] Assignee: BTM Corporation, Marysville, Mich.

[21] Appl. No.: 148,561

[22] Filed: Nov. 8, 1993

[51] Int. Cl.[6] ..... B25B 1/12

[52] U.S. Cl. ..... 269/239; 269/249; 269/285; 269/286

[58] Field of Search ..... 269/237, 238, 269/239, 228, 249, 285, 286, 258, 261, 901, 283; 254/122, 126, 28; 81/416, 422, 424

[56] References Cited

U.S. PATENT DOCUMENTS

| | | | |
|---|---|---|---|
| 3,965,779 | 6/1976 | Hannes et al. | 81/416 |
| 4,258,908 | 3/1981 | Goff et al. | 269/239 |
| 4,536,958 | 8/1985 | Tosi | 81/416 |
| 4,685,460 | 8/1987 | Thornton | 254/28 |
| 5,261,644 | 11/1993 | Armstrong | 254/126 |

OTHER PUBLICATIONS

"The World of Clamping" Brochure, De=Sta=Co, a Dover Resource Company, 1989, entire book.

"General Design Principles", Design Handbook for DuPont Engineering Polymers, pp. 104–108, Dupont (no date).

*Primary Examiner*—Robert C. Watson

*Attorney, Agent, or Firm*—Harness, Dickey & Pierce

[57] ABSTRACT

A clamp having internal snap-fit attachments has a first member, a second member and an actuating mechanism. At least one of the preceding members has a pair of sections thereof which are attached together by a plurality of snap-fit attachments.

10 Claims, 5 Drawing Sheets

CLAMP HAVING INTERNAL SNAP-FIT ATTACHMENTS

BACKGROUND AND SUMMARY OF THE INVENTION

This invention relates generally to clamps and specifically to clamps having internal snap-fit attachments therein.

Traditionally, a wide variety of clamp types have been used in many industries. These clamps commonly have a moving element which transfers force supplied by a manually actuated thumbscrew or lever arm, with or without a toggle action. The moving element applies clamping force against a workpiece which is abutted by a fixed element such as a non-movable arm, ledge or an adjacent table top. These conventional clamps are often made from a cast metal, which is relatively heavy and sometimes requires extra machining operations, or sheet metal which may require galvanizing or the like to prevent corrosion.

While stamped sheet metal clamps have been of lighter weight and lower cost than their cast metal counterparts, extra processing steps and fasteners have been required to join together the various components thereof. For example, various sections are attached together by rivets, welding or the like. This requires extraneous holding fixtures, capitol equipment, and added assembly labor. Therefore, a strong, lightweight, corrosion resistant, low cost and easy-to-assemble polymeric clamp is desirable.

In accordance with the present invention, a preferred embodiment of a new and useful clamp having internal snap-fit attachments provides a first member, a second member and an actuating mechanism. At least one of the preceding members has a pair of sections thereof which are attached together by a plurality of snap-fit attachments. Each snap-fit attachment is defined by a female receptacle portion and a mating male flanged portion. In another aspect of the present invention, the first member having a circular aperture therein is pivotably coupled to the second member. The aperture rotatably surrounds an exterior cylindrical surface created by a snap-fit attachment used within the second member. In a further aspect of the present invention, a linkage structure and coupling are provided which internally snap together and operably couple one of the members of the clamp to a thumbscrew.

Clamps of the present invention are preferably configured from a polymeric material. An advantage of the present invention construction is that a polymeric clamp is ideally suited for use in a corrosive environment or for clamping near electricity carrying members. Furthermore, the snap-fit design of the present invention is orientated in a direction transverse to the direction of clamping force thereby resisting inadvertent disassembly of the clamp. Moreover, the snap-fit attachment system of the present invention can be used in combination with a cantilever clamp, a ratcheted bar clamp, a vertical handle linked clamp, a straight line linked clamp, a toggle clamp, a C-clamp or a variety of other clamping designs generally known within the art. Accordingly, the present invention is advantageous over conventional clamps since the internal snap-fit attachments provide an easily assembled, low cost, lightweight, strong and durable fastening and pivoting structure for polymeric clamps.

Additional advantages and features of the present invention will become apparent from the following description and appended claims, taken in conjunction with the accompanying drawings.

DETAILED DESCRIPTION OF THE PREFERRED EMBODIMENT

Figure 1:
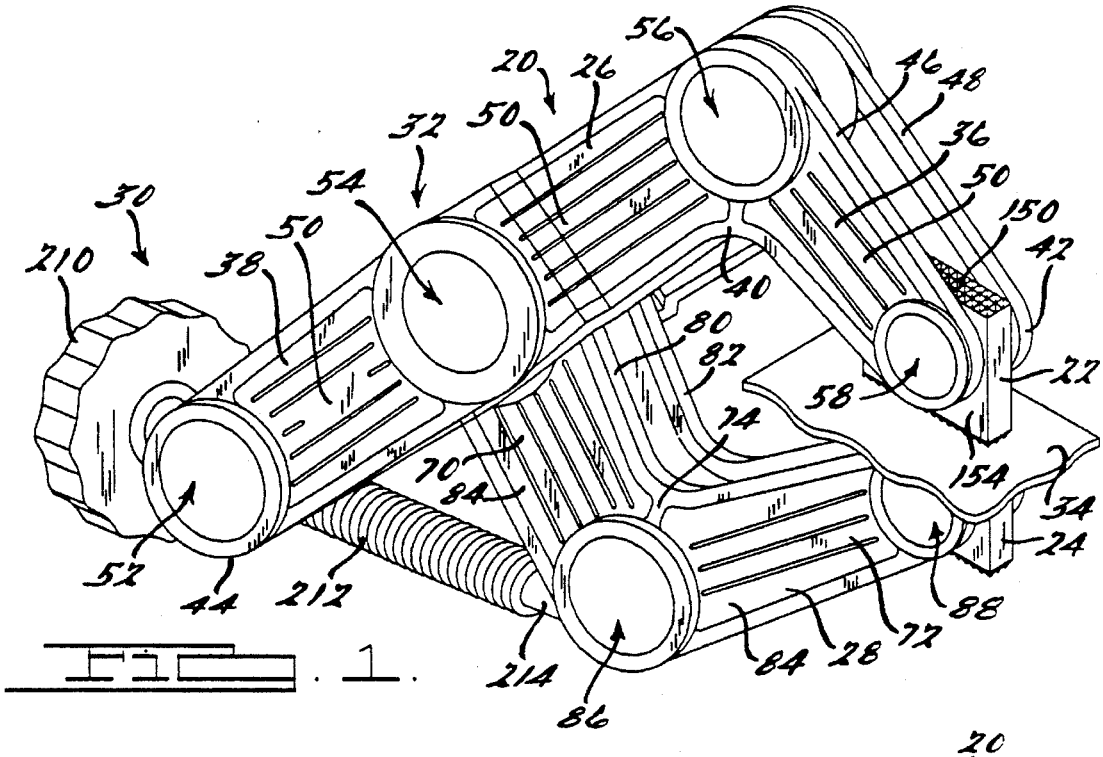
FIG. 1 is a perspective view showing a preferred embodiment of a cantilever clamp having internal snap-fit attachments of the present invention.
Figure 2:
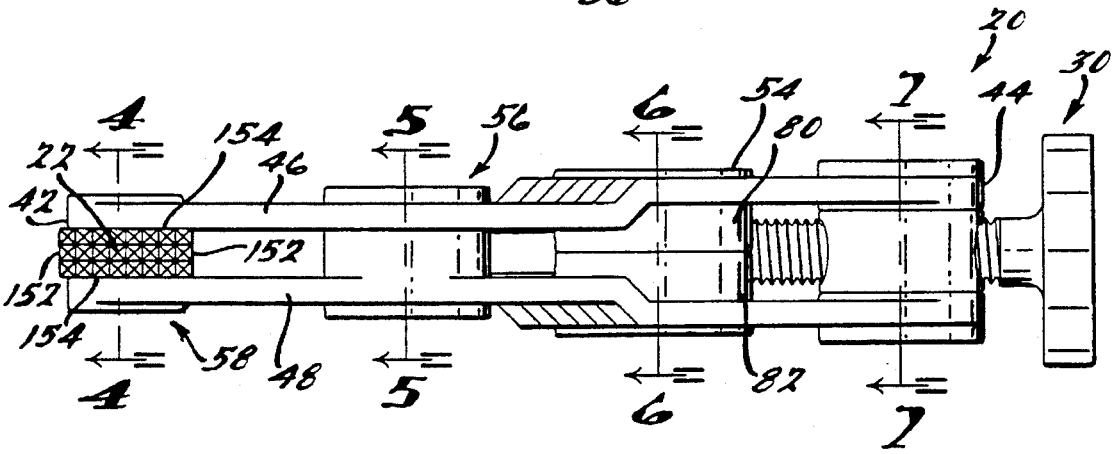
FIG. 2 is a top elevational view showing the present invention clamp of FIG. 1.
Figure 3:
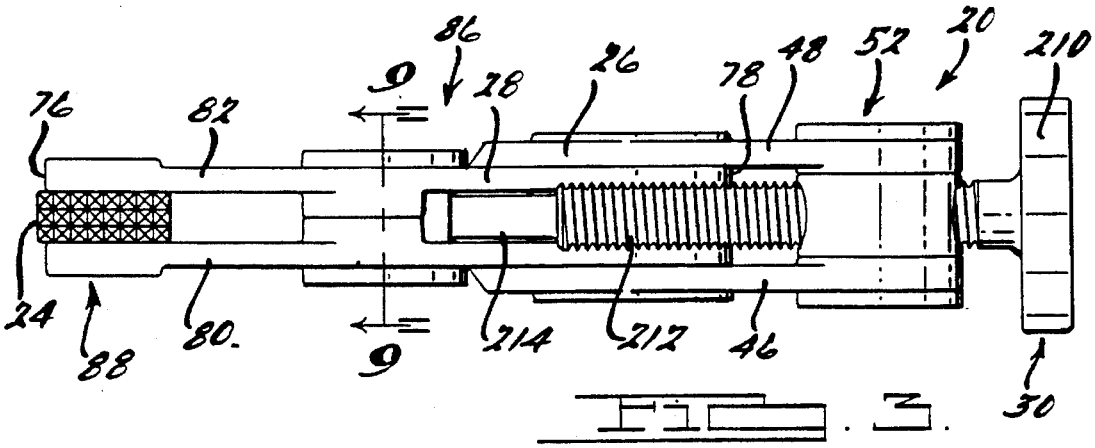
FIG. 3 is a bottom elevational view showing the present invention clamp of FIG. 1.
Figure 4:
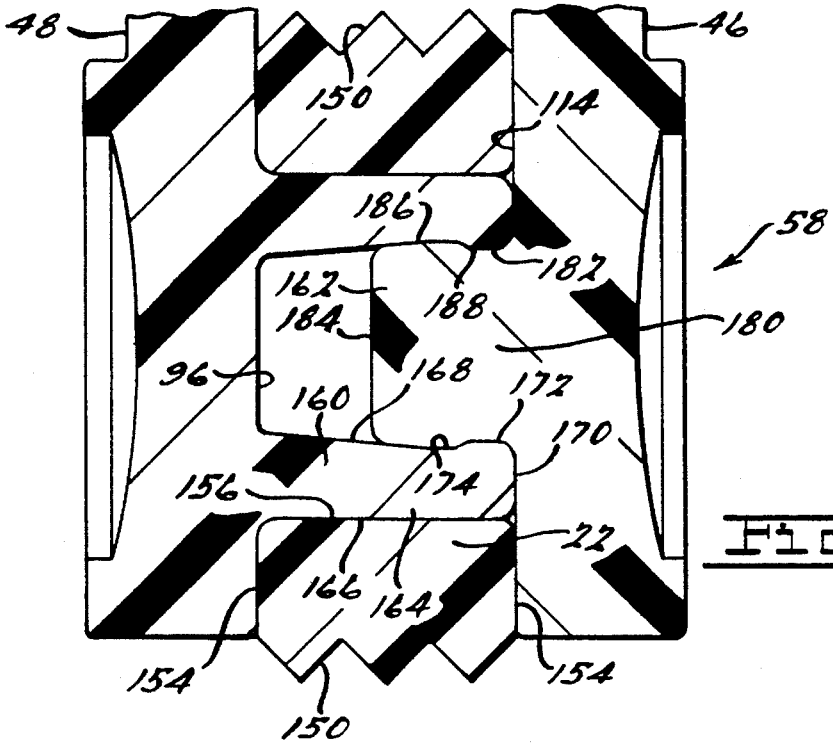
FIG. 4 is a cross sectional view showing the present invention clamp, taken along line 4—4 of FIG. 2.

The preferred embodiment of a cantilever clamp 20 having internal snap-fit attachments is best shown in FIGS. 1—3. Clamp 20 is comprised of a pair of gripping elements 22 and 24, a first arm 26, a second arm 28 and an actuating mechanism 30. Arms 26 and 28 are pivotably linked together at a pivot segment 32 and are movable by operation of actuating mechanism 30 engagably associated therewith. In obedience therewith, gripping elements 22 and 24 translate toward and away from one another so as to grip or release a workpiece 34.

First arm 26 is substantially L-shaped with a shorter leg 36 and a longer leg 38 joined at an apex 40. Furthermore, first arm 26 has a first extreme end 42 and a second extreme end 44. First arm 26 also is defined by a pair of sections 46 and 48 which are substantially symmetrical. Each substantially symmetrical section 46 and 48 has a plurality of structural segments 50 interposed between a plurality of snap-fit attachments 52, 54, 56 and 58. Structural segments 50 of section 46 are parallel to but spatially separated from structural segments 50 of section 48, thus, supplying strength and rigidity for clamp 20.

Second arm 28 has a V-shaped configuration defined by a first leg 70 and second leg 72. Legs 70 and 72 are joined at an apex 74. Furthermore, second arm 28 has a first extreme end 76 and a second and opposite extreme end 78. As with first arm 26, second arm 28 is similarly defined by a pair of substantially symmetrical sections 80 and 82 which are further comprised of a pair of structural segments 84 and snap-fit attachments 86 and 88.

Figure 6:
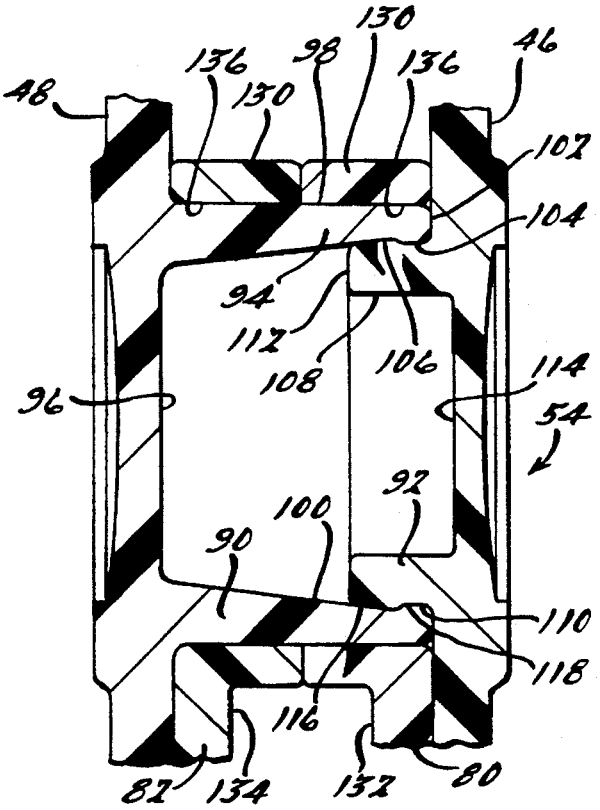
FIG. 6 is a cross sectional view showing the present invention clamp, taken along line 6—6 of FIG. 2.
Figure 7:
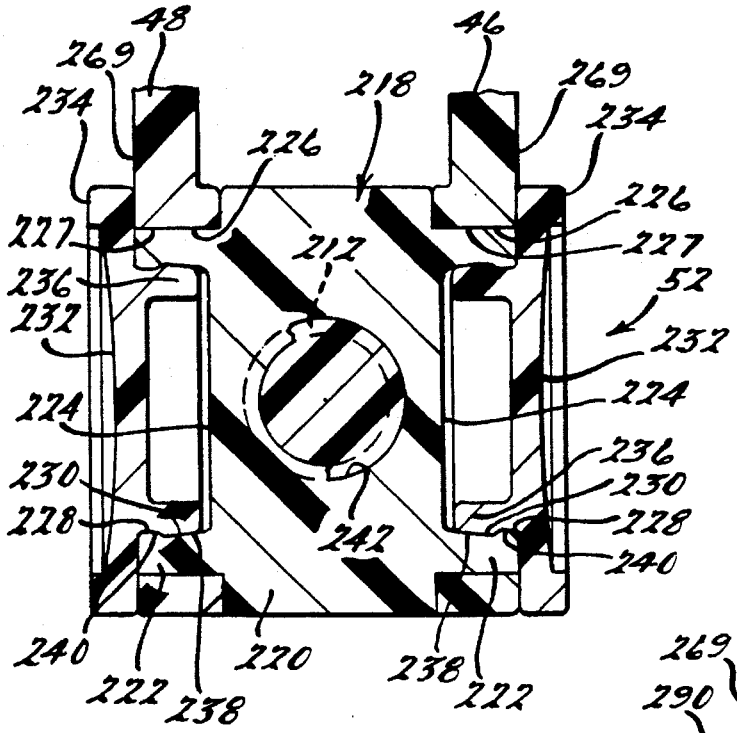
FIG. 7 is a cross sectional view showing the present invention clamp, taken along line 7—7 of FIG. 2.
Figure 9:
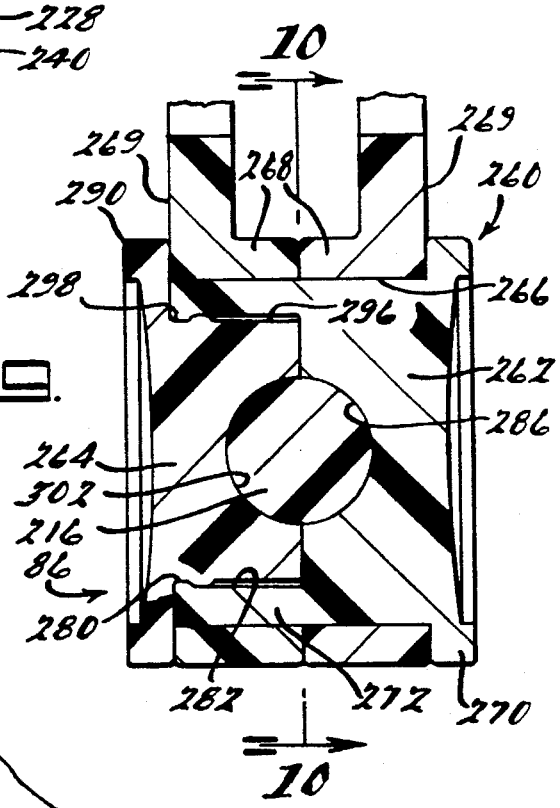
FIG. 9 is a cross sectional view showing the present invention clamp, taken along line 9—9 of FIG. 3.
Figure 10:
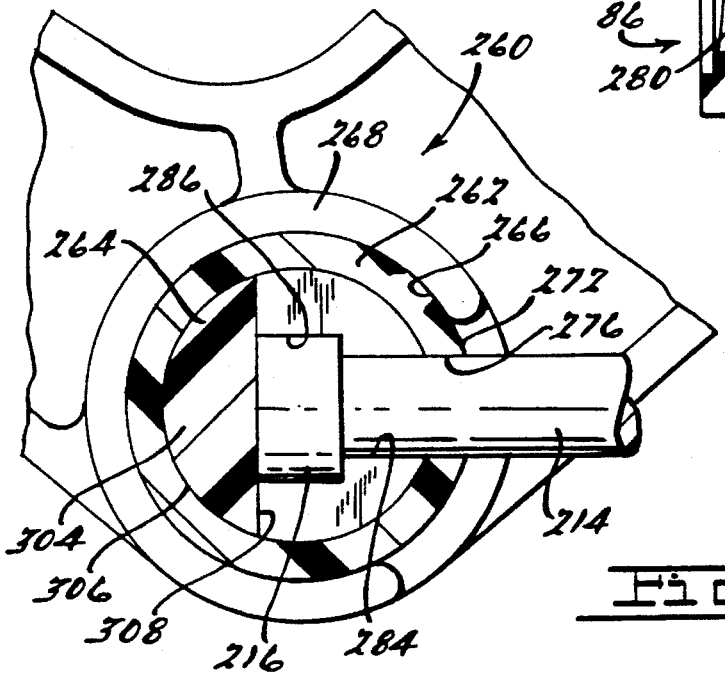
FIG. 10 is a sectional view showing the present invention clamp, taken along line 10—10 of FIG. 9.
Figure 8:
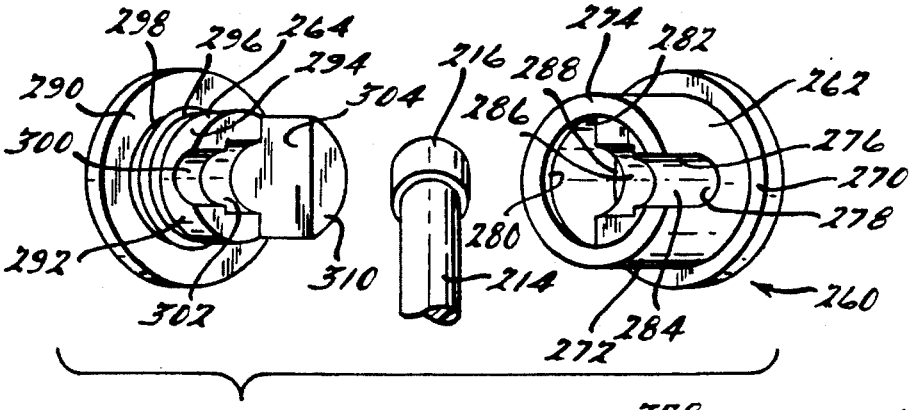
FIG. 8 is an exploded perspective view showing a linkage structure of the present invention clamp of FIG. 1.

Second arm 28 is pivotably linked with first arm 26 at pivot segment 32 which contains snap-fit attachment 54. This can best be seen in FIG. 6. Snap-fit attachment 54 is further comprised of a female receptacle 90 and a male flanged portion 92 inserted therein. Female receptacle 90 has an annular-shaped wall 94 projecting from an internal face 96 of section 48. An outer circumferential surface 98 of projecting wall 94 is cylindrical in shape as is an inner circumferential surface 100. Projecting wall 94 further has a distal edge 102 opposite from section 48. Inner circumferential surface 100 has an inwardly turned lip 104 proximate with distal edge 102 and an undercut 106 adjacent to lip 104 opposite from distal edge 102. Projecting wall 94 has somewhat flexible and resilient properties thereof. The mating male flanged portion 92 has an annular wall 108 with a cylindrical y-shaped exterior surface 110 and a distal edge 112 located opposite from an internal face 114 of section 46. Exterior surface 110 of male flanged portion 92 is additionally defined by a radially expanded flange 116 and an adjacent undercut 118. During insertion of male flanged portion 92 into female receptacle 94, flange 116 acts to expand lip 104 due to the interference therebetween. When fully snapped together, flange 116 of male flanged portion 92 engages undercut 106 of female receptacle 94. Also, lip 104 of female receptacle 94 engages undercut 118 of male flanged portion 92. Therefore, substantially symmetrical sections 46 and 48 are securely held together at pivot segment 32. Moreover, sections 80 and 82 of second arm 28 each have a cylindrical boss 130 extending from the respective internal faces 132 and 134 thereof. Bosses 130 have inside bearing surfaces 136 which define an aperture therethrough. Accordingly, inside bearing surfaces 136 operably surround outer circumferential surface 98 of female receptacle 90 such that movable arm 28 is pivotable therearound. Therefore, snap-fit attachment 54 acts as both a fastener and a pivot.

Referring to FIGS. 1–4, each gripping element 22 and 24 is defined as a hexahedron having a pair of gripping surfaces 150 with pyramidal serrations thereon, a pair of transverse surfaces 152 and a pair of lateral surfaces 154. Each gripping element 22 and 24 further has a cylindrical inside surface 156 which defines a transverse bore. Additionally, snap-fit attachment 58 is comprised of a female receptacle 160 and a male flanged portion 162. Female receptacle 160 has a projecting wall 164 of annular shape protruding from internal face 96 of section 48. Projecting wall 164 has an outer circumferential surface 166 and an inner circumferential surface 168 with a distal edge 170 thereabout. Furthermore, inner circumferential surface 168 has an inwardly turned lip 172 extending inward therefrom proximate with distal edge 170. An undercut 174 is located adjacent to lip 172 opposite from distal edge 170. In concert, male flanged portion 162 of snap-fit attachment 58 has a protruding structure 180 with an exterior surface 182 of substantially cylindrical shape. Male flanged portion 162 further has a distal edge 184 opposite from internal face 114 of section 46. Exterior surface 182 has a radially extending flange 186 proximate with distal edge 184 and an undercut 188 is located between lip 186 and internal face 114. Male flanged portion 162 preferably has a solid center so as to add strength and rigidity, however, the center could alternatively be hollow. Female receptacle 160 and male flanged portion 162 engage in a fashion similar to snap-fit attachment 54. Snap-fit attachment 58 further acts as a rotational bearing surface for inside surface 156 of gripping elements 22 and 24. Therefore, snap-fit attachment 58 serves dual roles.

Figure 5:
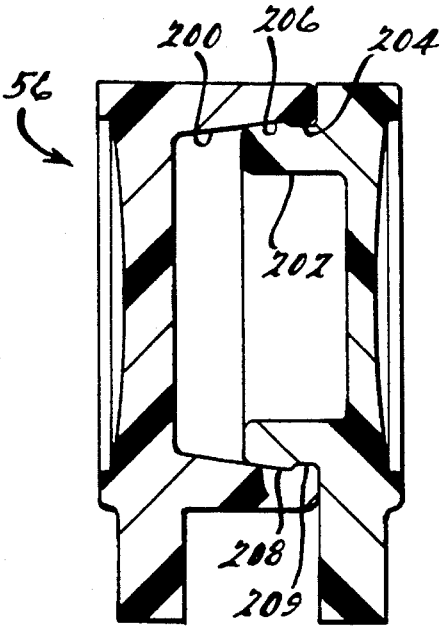
FIG. 5 is a cross sectional view showing the present invention clamp, taken along line 5—5 of FIG. 2.

In FIG. 5, a simpler snap-fit attachment 56 is shown. This snap-fit attachment 56 is constructed from a female receptacle 200 and a male flanged portion 202. Female receptacle 200 has an inwardly turned lip 204 and an undercut 206 while male flanged portion 202 has an outwardly directed flange 208 and an undercut 209. Snap-fit attachment 56 operates similar to the previously described snap-fit attachment 54.

Referring to FIGS. 1, 3 and 7–10, an actuating mechanism or thumbscrew 30 is shown. Thumbscrew 30 has a knob 210, an externally threaded section 212, a cylindrical unthreaded dowel 214 and a diametrally expanded joint 216 all in respective axial alignment with one another. Threaded section 212 of thumbscrew 30 is enmeshed with an internally threaded linkage structure 218 which acts in conjunction with snap-fit attachment 52. Linkage structure 218 is defined by a barrel-shaped body 220 having an annular wall 222 extending outward from each end 224 thereof. In associated relationship therewith, sections 46 and 48 of first arm 26 have a circular inside edge 226 therein proximate with extreme end 44 such that an orifice 227 extends therethrough. In turn, annular walls 222 of linkage structure 21 8 concentrically fit within each orifice 227 of first arm 26. Furthermore, each annular wall 222 has an internal lip 228 inwardly projecting therefrom with an adjacent undercut 230. Additionally, linkage structure 218 and snap-fit attachment 52 are further defined by a pair of caps 232 each having a shoulder 234 of larger dimension than the adjacent orifice 227. Each cap 232 further has an inner annular wall 236 extending inward therefrom with a circumferential flange 238 and an adjacent undercut 240 for snap-fit engagement with lip 228 and undercut 230 of body 220. Thus, substantially symmetrical sections 46 and 48 are trapped between shoulders 234 of caps 232 and body 220. Moreover, body 220 has a threaded tunnel 242 bored transversely therethrough for enmeshed engagement with threaded section 212 of thumbscrew 30. Therefore, thumbscrew 30 is incrementally adjustable in relation to first arm 26.

Thumbscrew 30 acts in combination with linkage structure 218 and a coupling 260 to translate second arm 28 and gripping element 24 in relation to first arm 26 and its respective gripping element 22. Coupling 260 simultaneously acts as a snap-fit attachment 86 and is comprised of an outer shell 262 and an inner plug 264. At apex 74 of second arm 28 there is a second circular edge 266 formed by inwardly facing bosses 268 defining a cylindrical port therethrough. Shell 262 has an expanded shoulder 270 with a larger circumferential dimension than the adjacent second circular edge 266 and port for retention against an outside surface 269 of first arm 26. Shoulder 270 further has a cylindrical wall 272 extending inward therefrom with a distal edge 274 and a channel 276. Channel 276 has a semi-circular shape 278 at its bottom. A trough 284 of shell 262 continues transversely inward radially past cylindrical wall 272 and ends in a semicylindrical expanded seat 286 centrally juxtaposed within shell 262. A pocket 288 is located between seat 286 and cylindrical wall 272 diametrally opposite from channel 276. Also, cylindrical wall 272 of shell 262 has an inwardly turned lip 280 with an adjacent undercut 282.

Plug 264 has a circular shoulder 290, similar to that of shell 262, and has an inner structure 292 with a cylindrical outer surface 294. Cylindrical outer surface 294 has an enlarged cylindrical bead 296 and an undercut 298 for engagement with lip 280 and undercut 282 of shell 262. This provides for snap-fit attachment 86. Furthermore, inner structure 292 of plug 264 has a semi-cylindrical channel 300 which transversely extends toward the radial centerline of the part and ends in a semi-cylindrical expanded seat 302. Plug 264 further has a backstop 304 projecting from a portion of inner structure 292 adjacent to seat 302 and diametrally opposite from channel 300. Backstop 304 has a semi-cylindrical outer surface 306 and a flat abutting surface 308 bordered by a semi-circular end 310. Accordingly, when plug 264 and shell 262 are snapped together surrounding dowel 214 and joint 216 of thumbscrew 30, backstop 304 fits within pocket 288 and joint 216 is rotatably trapped within seats 302 and 286. Furthermore, dowel 214 is rotatably journalled within channel 300 of plug 264 and trough 284 of shell 262. Arms 26 and 28, gripping elements 22 and 24, thumbscrew 30, linkage structure 218 and coupling 260 are all injection molded from a glass filled nylon polymeric material.

Figure 11:
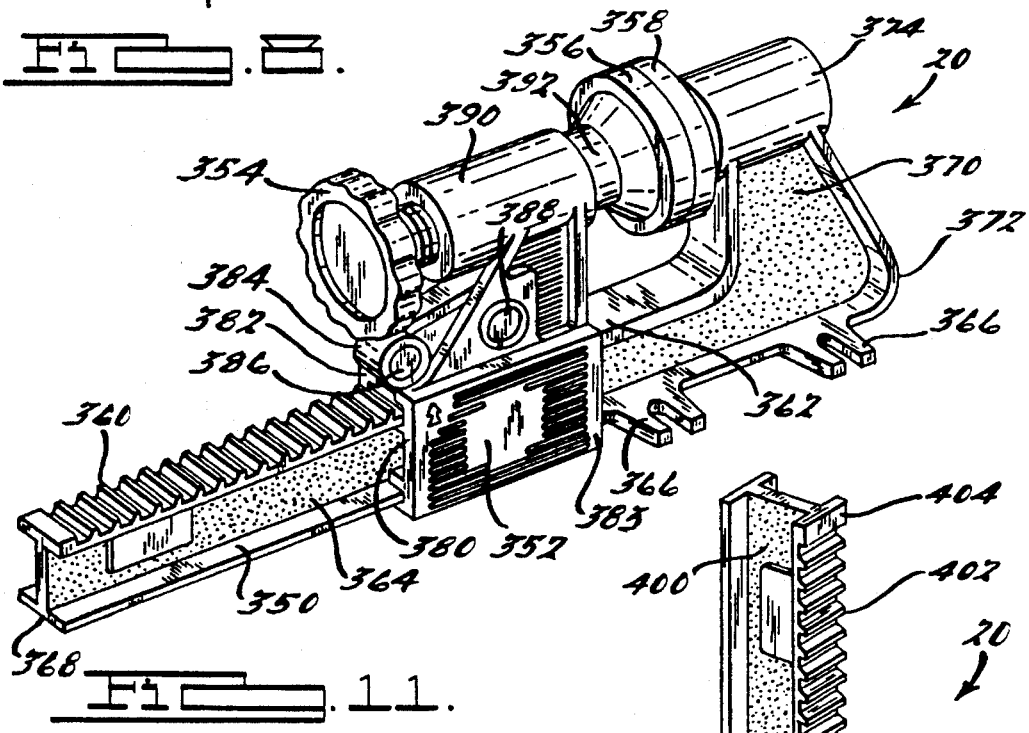
FIG. 11 is a perspective view showing a first alternate embodiment of the present invention clamp.

A first alternate embodiment of a bar clamp of the present invention 20 is illustrated in FIG. 11. Bar clamp 20 is comprised of a ratcheted bar 350, a housing 352, a thumbscrew 354, a movable gripping element 356 and a stationary gripping element 358. Ratcheted bar 350 has a substantially I-beam cross sectional shape and a J-shaped elevational side view configuration. A set of serrated teeth 360 project along a portion of an inside edge 362 of an elongated leg 364 of the J-shaped configuration. Furthermore, a plurality of hold down formations 366 extend from a portion of an outside edge 368 of elongated leg 364. Additionally, an extension piece 370 projects from an end 372 of elongated leg 364. Stationary gripping element 358 is affixed to a boss 374 which is, in turn, integral with extension piece 370.

Housing 352 is constructed from a pair of sections 380 and 382 having substantially symmetrical portions 383 which engage around elongated leg 364 such that a release mechanism 384 can engage teeth 360. Housing 352 can be axially translated along elongated leg 364 by manually pivoting a portion 386 of release mechanism 384 away from teeth 360. Release mechanism 384 is normally spring loaded so as to urge release mechanism 384 into locked engagement with teeth 360. Furthermore, sections 380 and 382 of housing 352 are retained together by a plurality of snap-fit attachments 388 which can be constructed similar to those aforementioned for the preferred embodiment cantilever clamp 20. Section 380 further has an internally threaded mount 390 integral therewith through which an actuating mechanism, such as thumbscrew 354, is in enmeshed engagement. Movable gripping element 356 is secured to a distal end 392 of thumbscrew 354 in axial alignment with stationary gripping element 358. All of the components of bar clamp 20, excluding any spring means, are injection molded from a glass filled nylon polymeric material.

Figure 12:
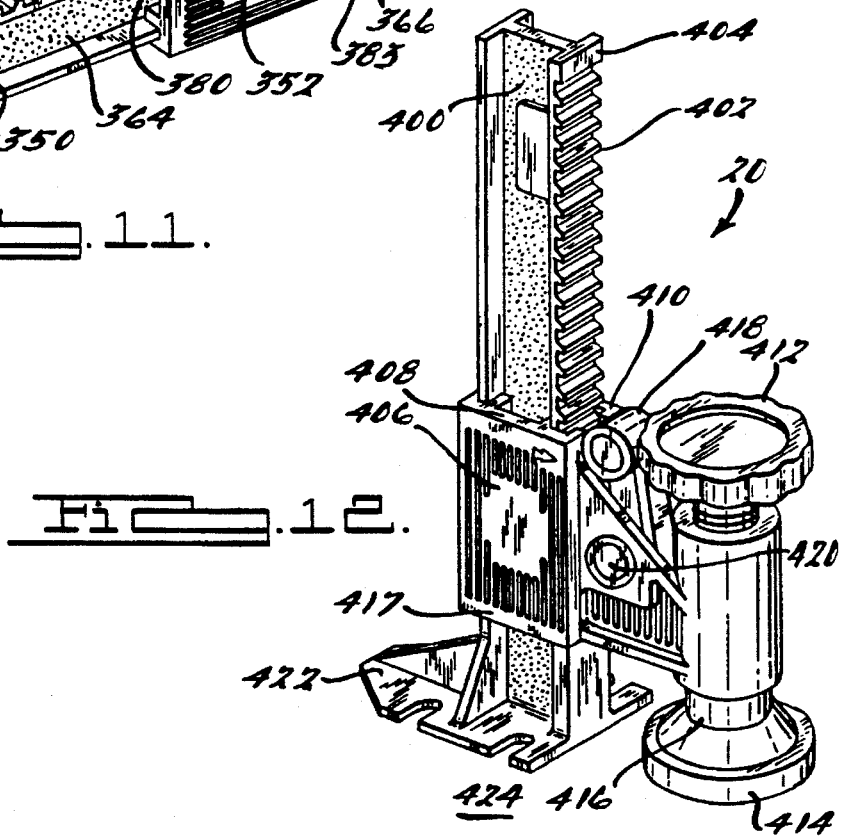
FIG. 12 is a perspective view showing a second alternate embodiment of the present invention clamp.

Referring to FIG. 12, a second alternate embodiment bar clamp 20 of the present invention is similar to the exemplary embodiment shown in FIG. 11 except that a ratcheted bar 400 does not have an extension piece 370 (see FIG. 11) and a stationary gripping element 358 (see FIG. 11 ). Nevertheless, clamp 20, as shown in FIG. 12, is comprised of ratcheted bar 400 having a set of serrated teeth 402 along a side 404 thereof, a housing 406 being defined by a pair of sections 408 and 410, a thumbscrew 412 and a gripping element 414 affixed to an end 41 6 thereof. As with the previous embodiment, housing 406 also has substantially symmetrical portions 417 and a spring loaded actuation mechanism 418 therein for engagement with teeth 402. At least one snap-fit attachment 420, being defined by a female receptacle (not shown) and a male flanged portion (not shown), act to retain sections 408 and 41 0 to one another in a fashion similar to that of the preferred embodiment. Moreover, ratcheted bar 400 has a hold down formation 422 integrally formed in an end thereof. Thumbscrew 412 is operable to engage a workpiece 34 (see FIG. 1) between gripping element 414 and an adjacent tabletop 424. As with the previous embodiments, with the exception of the spring means, bar clamp 20 is entirely injection molded from a glass filled nylon polymeric material.

Figure 13:
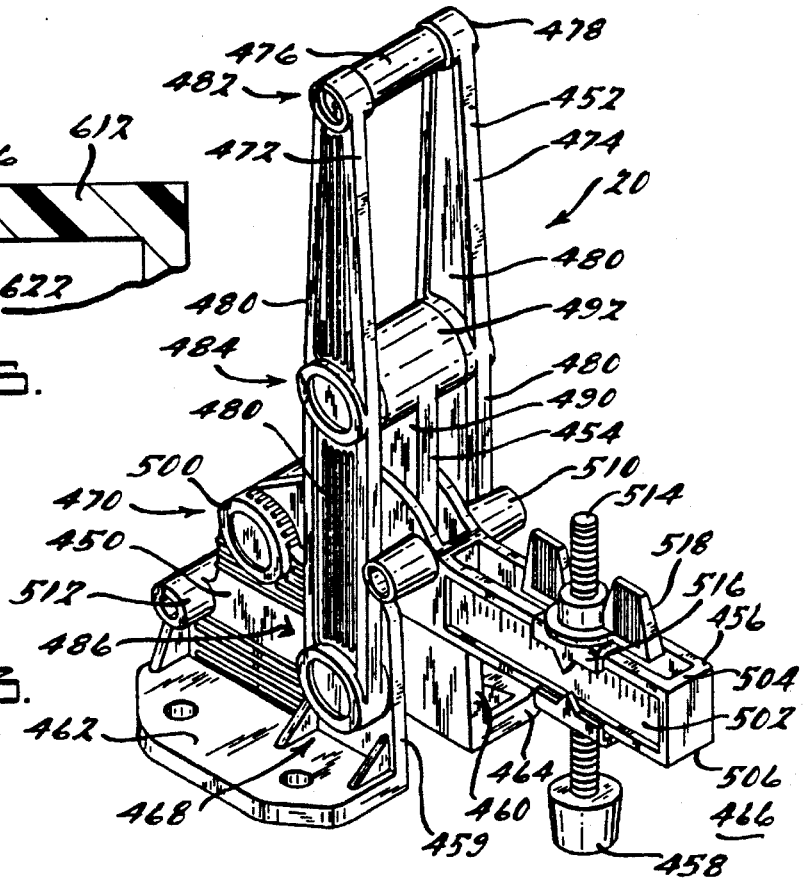
FIG. 13 is a perspective view showing a third alternate embodiment of the present invention clamp.

A third alternate embodiment can be seen in FIG. 13 where there is a vertical handle linked clamp 20 of the present invention. Vertical handle linked clamp 20 is comprised of a base 450, a handle 452, a plunger 454, a boom 456 and a gripping element 458. Base 450 has a pair of upstanding walls 459 and 460 with a pair of platforms 462 and 464 protruding outward from a bottom corner thereof. Platforms 462 and 464 can be bolted to an adjacent tabletop 466. Furthermore, base 450 has a first pivot structure 468 and a second pivot structure 470.

Handle 452 is comprised of a pair of substantially symmetrical sections 472 and 474 which have a cylindrical extension 476 located therebetween at an upper end 478. A pair of structural segments 480 are interposed between a plurality of snap-fit attachments 482, 484 and 486 along each section 472 and 474. Snap-fit attachment 482 is similar to the aforementioned female receptacle 56 (see FIG. 5) wherein extension 476 is operable in a manner similar to male flanged portion 202 (see FIG. 5). Furthermore, plunger 454 has a central beam 490 bordered by a first pivotable end 492 and a second pivotable end (not shown). First pivotable end 492 surrounds snap-fit attachment 484 in a fashion similar to that of snap-fit attachment 54 (see FIG. 6). Moreover, handle 452 is pivotably engaged upon each upstanding wall 459 and 460 of base 450 through snap-fit attachments 486.

Additionally, boom 456 is defined by an end pivot 500, a central pivot (not shown) and a calibrated hollow beam 502 which has open top and bottom surfaces, respectively 504 and 506. Boom 456 is pivotably attached to second pivot structure 470 of base 450 at end pivot 500. This is performed by a snap-fit engagement similar to snap-fit attachment 54 (see FIG. 6). Similarly, boom 456 is actuated by pivotable engagement with the second pivot end of plunger 454. Such a pivot is carried out as a snap-fit attachment similar to that of snap-fit attachment 58 (see FIG. 4). A pair of bumpers 510 protrude from sides of boom 456 and an abutment surface 512 mounted on base 450 so as to prevent overtravel of handle 452 when gripping element 458 is in its open position. All of the aforementioned components are injection molded from glass filled nylon polymeric material. Gripping element 458 is adjustably attached to boom 456 by an externally threaded screw 51 4, a C-shaped slide 516 and a wing nut 518. Gripping element 458 has a frusto-conical shape and traps a workpiece 34 (see FIG. 1 ) against the adjacent tabletop 466.

Figure 15:
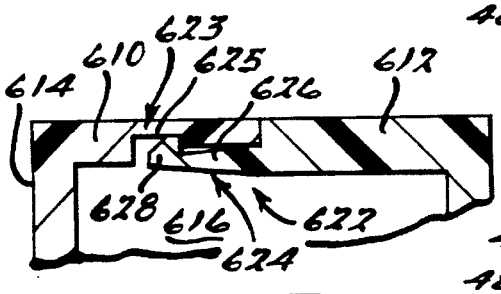
FIG. 15 is a sectional view, taken along line 15—15 of FIG. 14, showing a cantilevered snap-fit used in the fourth alternate embodiment of the present invention clamp.
Figure 14:
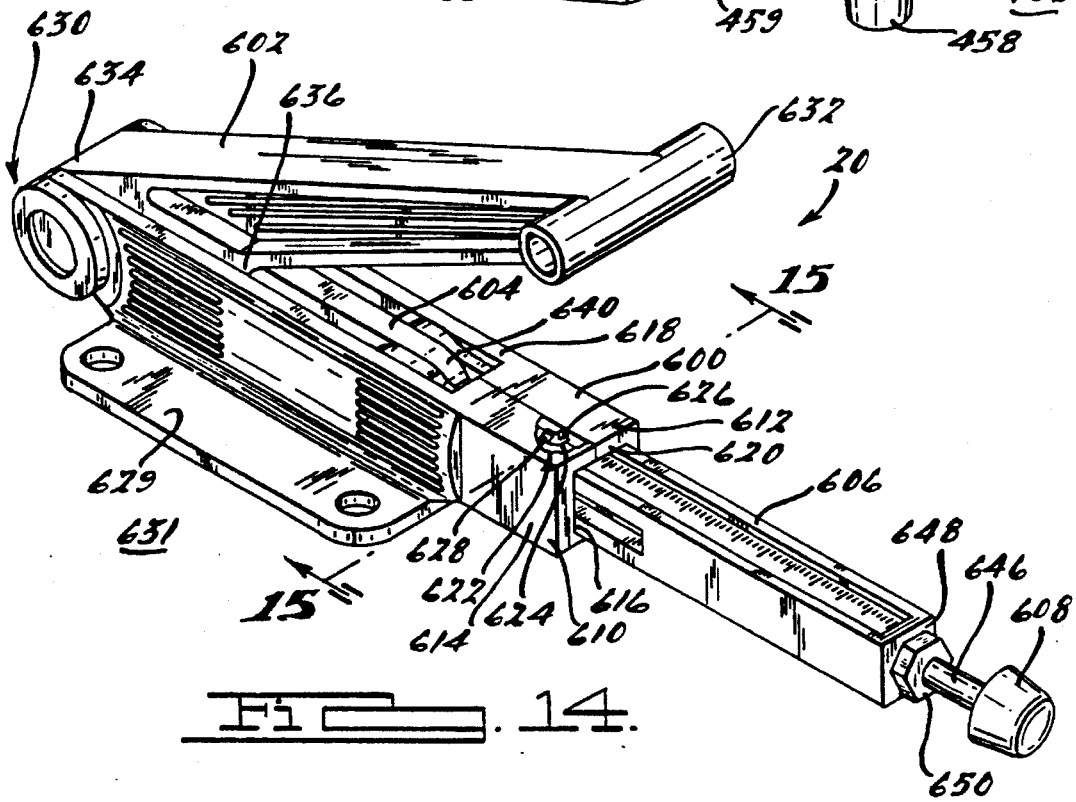
FIG. 14 is a perspective view showing a fourth alternate embodiment of the present invention clamp.

Referring to FIGS. 14 and 15, a fourth alternate embodiment of a straightline linked clamp 20 of the present invention is comprised of a casing 600, a lever 602, a linkage shaft 604, an extension arm 606 and a gripping element 608. Casing 600 is comprised of a pair of substantially symmetrical sections 610 and 612 each having an outer wall 614 with a hollow 616 extending longitudinally therethrough. Furthermore, outer wall 614 has a partially open top surface 618 and an open first end 620. Sections 61 0 and 612 are joined together by a plurality of snap-fit attachments 622. Snap-fit attachments 622 are defined by a female receptacle 623, such as a recess 625, hole (not shown) or U-shaped member (not shown) having a central opening, and a male flanged portion 624 have a cantilevered beam 626 with a barbed formation 628 extending from a distal end thereof. Additionally, one of the aforementioned annular snap-fit attachments, such as snap-fit attachment 54 (see FIG. 6) can be used in combination with a pivot structure 630. Casing 600 also has a platform 629 projecting from a lower portion thereof for attachment to a work surface 631.

Lever 602 has a handle section 632, a central pivot section 634 and a connection section 636. Pivot section 634 of lever 602 is rotatably engaged with pivot structure 630 of casing 600. Also, connection section 636 is juxtaposed within casing 600 such that handle section 632 protrudes from open top surface 618. Additionally, linkage shaft 604 is positioned within casing 600 and has a first end (not shown) rotatably coupled with connection section 636 for translating leveraging forces to extension arm 606 which is rotatably coupled with a second end 640 of linkage shaft 604. Such an attachment can be constructed through a snap-fit attachment such as snap-fit attachment 54 (see FIG. 6) when extension arm 606 is constructed from substantially symmetrical sections. Moreover, extension arm 606 is partially located within casing 600 such that a majority extends through open first end 620 and is extensible and retractable therefrom. Gripping element 608 is frusto-conical in shape and is mounted upon a partially threaded dowel 646 which is enmeshed with a second end 648 of extension arm 606. A nut 650 further positionally secures dowel 646 in relation to extension arm 606.

As can be observed from all the preceding embodiments, the present invention clamps are advantageous over the prior art in that a majority of the components are in snap-fit engagement with one another. Furthermore, for at least the majority of constructions, no other fasteners are required to supplement the snap-fit attachments. Additionally, many of these snap-fit attachments serve multiple functions. For example, some snap-fit attachments serve to retain structural sections while also providing a bearing surface upon which linked arms can be pivotably attached. Also, other snap-fit attachments serve to fasten a pair of sections together while acting as a fixed linkage structure or a movable coupling. Moreover, the many polymeric clamp components can be quickly and easily assembled, disassembled and reassembled together to provide a low cost, lightweight, strong and durable clamp assembly. These polymeric clamps are further advantageous since they cannot be corroded and are insulated from electrical current.

While various embodiments of a clamp have been disclosed, it will be appreciated that various modifications may be made without departing from the present invention. For example, the cantilevered beam and barb snap-fit disclosed for use with the straightline linked clamp may similarly be used for any of the other clamp embodiments. Alternatively, the annular style snap-fit attachments, as disclosed in the preferred embodiment, can also be used in combination with any of the other constructions. Furthermore, alternate actuating means can be used in place of the thumbscrew, handles or levers to supply clamping forces to the movable members. Various materials have been disclosed in an exemplary fashion, however, other materials may of course be employed. It is intended by the following claims to cover these and any other departures from the disclosed embodiments which fall within the true spirit of this invention.

The invention claimed is:

1. A cantilever clamp comprising:

a pair of gripping elements;

a linkage structure having an internally threaded tunnel running therethrough;

a first arm and a second arm both being pivotably linked to one another at a pivot segment, said linked arms each being further defined by said pair of sections, a plurality of interlocking snap-fit attachments fastening said pair of sections together;

said first arm having a substantially L-shape with one of said pair of gripping elements being rotatably affixed to a first extreme end of a shorter leg of said L-shaped arm and said linkage structure being affixed to a second extreme end of a longer leg of said L-shaped arm, said second extreme end of said first arm having a circular inside edge defining an orifice therethrough;

said second arm being substantially V-shaped with another of said pair of gripping elements being rotatably affixed to a first extreme end surrounding one of said plurality of snap-fit attachments, an opposite and second extreme end of said second arm having a first circular edge creating an aperture therethrough rotatably surrounding one of said plurality of snap-fit attachments, said circular aperture of said second arm and said surrounded one of said plurality of snap-fit attachments of said fixed arm defining said pivot segment, said second arm having a second circular edge located within the apex of the V-shaped configuration defining a cylindrical port therethrough;

a thumbscrew having a knob, a threaded section and a joint all in respective axial alignment;

a coupling being positioned partially within said port of said second arm; and said threaded section of said thumbscrew being enmeshed with said internally threaded tunnel of said linkage structure which is attached to said first arm opposite from one of said pair of gripping elements, said joint of said thumbscrew being rotatably affixed to said coupling attached to said second arm;

whereby said second arm is retractable toward and extendable away from said linkage structure upon rotation of said thumbscrew such that said pair of gripping elements translate away from and toward one another, respectively.

2. The clamp of claim 1 wherein:

said coupling has an outer shell and an inner plug both being positioned partially within said port of said second arm, said shell has an expanded shoulder with a larger dimension than said port for retention against an outside surface of said first arm, said shoulder further has a cylindrical wall extending therefrom with a distal edge having a channel cut therein, said cylindrical wall of said shell has a lip projecting radially inward therefrom with an adjacent undercut thereabout, a trough is located at a bottom of said channel closest to said shoulder, said trough of said shell continues transversely inward radially past said wall and ends in a semi-cylindrical expanded seat centrally juxtaposed therein, said plug has a shoulder similar to that of said shell and has an inner structure with a substantially cylindrical outer surface extending therefrom, said outer surface has an enlarged cylindrical bead and an adjacent undercut therearound for engagement with said lip and said undercut of said shell, said inner structure of said plug further has a semi-cylindrical channel formed therein transversely extending toward said radial centerline and ends in a semi-cylindrical expanded seat, both said channel and said seat of said plug are symmetrical and in positional agreement with said channel and said seat of said shell when assembled together, said inner structure of said plug further has a back stop located adjacent to said seat and circumferentially opposite from said channel; and said joint of said thumbscrew being rotatably trapped within said seats of said outer shell and said plug and being prevented from axial disengagement therefrom by the smaller diametral dimension of said troughs of said shell and said plug through which a predetermined portion of said thumbscrew extends.

3. The clamp of claim 1 wherein:

said linkage structure is defined by a barrel-shaped body having an annular wall extending outward from each end fitting within said orifice through said first arm, each of said annular walls have an internal lip and undercut therein, said linkage structure further has a pair of caps defined by a shoulder of larger dimension than said orifices and has an inner annular wall extending therefrom with an outer circumferential flange and undercut adjacent thereto for snap-fit engagement with said annular walls extending from said body, said body of said linkage structure further has said threaded tunnel bored transversely therethrough.

4. The clamp of claim 1 wherein:

said plurality of snap-fit attachments are each comprised of a female receptacle and a male flanged portion, said female receptacles each have a projecting wall with a substantially cylindrical shape, said projecting wall further has an outer circumferential surface and an inner circumferential surface with a distal edge thereabout, said inner circumferential surface of said projecting wall has an inwardly turned lip proximate with said distal end and an undercut is adjacent thereto, said projecting wall has somewhat flexible and resilient properties;

said male flanged portions each have a protruding structure with an exterior surface therearound and a distal edge thereon, said exterior surface is substantially cylindrical in shape and has a flange thereabout radially extending proximate with said distal edge with an undercut adjacent thereto, said flange acts to expand said lip of each of said receptacles when inserted therepast, said flange interlockably engages said undercut of each of said receptacles and said lip interlockably engages said undercut of each of said flanged portions when fully snapped together; and said plurality of snap-fit attachments are the sole means of retention between said pair of sections.

5. The clamp of claim 1 wherein:

said first member and said second member are made from a polymeric material.

6. A clamp comprising:

a first arm and a second arm being linked together for pivotable movement therebetween, a snap-fit attachment being secured to said first arm;

an actuation mechanism having a first engagement segment and a second engagement segment;

an internally threaded linkage structure which is attached to one of said arms being in incrementally adjustable association with said first engagement segment of said actuation mechanism, said second engagement segment being rotatably affixed to a preselected portion of the other of said arms, one of said arms being retractable toward and extendable away from said linkage structure upon movable adjustment of said actuation mechanism such that said pair of arms translate away from and toward one another, respectively;

said second arm having a first circular edge creating an aperture therethrough which rotatably surrounds said snap-fit attachment secured to said first arm, said circular aperture of said second arm and said surrounded snap-fit attachment of said first arm defining a pilot;

said snap-fit attachment being comprised of a female receptacle and a male flanged portion, said female receptacle having a projecting wall with a substantially cylindrical shape, said projecting wall further having an outer circumferential surface and an inner circumferential surface with a distal edge, said inner circumferential surface of said projecting wall having an inwardly turned lip proximate with said distal end and an undercut, said projecting wall having somewhat flexible and resilient properties; and said male flanged portion having a protruding structure with an exterior surface and a distal edge, said exterior surface being substantially cylindrical in shape and having a flange radially extending proximate with said distal edge with an undercut, said flange acting to expand said lip of each of said receptacles when inserted therepast, said flange interlockably engaging said undercut of said receptacle and said lip interlockably engaging said undercut of said flanged portion when fully snapped together.

7. A clamp comprising:

a first arm having an outside surface and an inside surface;

a second arm having a circular edge located within a preselected portion defining a cylindrical port;

an actuation mechanism having a diametrally expanded joint;

a coupling having an outer shell and an inner plug both being positioned partially within said port of said second arm for engagement of said actuation mechanism, said shell having an expanded shoulder with a larger dimension than said port for retention against said outside surface of said first arm, said shoulder further having a cylindrical wall extending therefrom with a distal edge having a channel, said cylindrical wall of said shell having a lip projecting radially inward therefrom with an adjacent undercut, a trough being located at a bottom of said channel closest to said shoulder, said trough of said shell continuing transversely inward radially past said wall and ending in a semi-cylindrical expanded seat, said plug having a shoulder and having an inner structure with a substantially cylindrical outer surface extending therefrom, said outer surface having an enlarged cylindrical bead and an adjacent undercut for engagement with said lip and said undercut of said shell, said inner structure of said plug further having a semi-cylindrical channel transversely extending toward said radial centerline and ending in a semi-cylindrical expanded seat, both said channel and said seat of said plug being symmetrical and in positional agreement with said channel and said seat of said shell when assembled together, said inner structure of said plug further having a back stop located adjacent to said seat and circumferentially opposite from said channel; and said joint of said actuation mechanism being rotatably trapped within said seats of said shell and said plug and being prevented from axial disengagement therefrom by the smaller diametral dimension of said troughs of said shell and said plug through which a preselected portion of said actuation mechanism extends.

8. A clamp comprising:

a member having a pair of substantially parallel sections each further having a circular inside edge defining an orifice therethrough;

a thumbscrew having a knob and an externally threaded section;

a linkage structure being defined by a barrel-shaped body having an annular wall extending outward from each end which fits within said orifices through said member, each of said annular walls having an internal lip and undercut, said linkage structure further having a pair of caps defined by a shoulder of larger dimension than said orifices and having an inner annular wall extending therefrom with an outer circumferential flange and undercut adjacent thereto for snap-fit engagement with said annular walls extending from said body, said body of said linkage structure further having a threaded tunnel bored transversely therethrough; and said pair of substantially parallel sections each being engagably trapped between an adjacent one of said pair of caps and said body, said threaded section of said thumbscrew being enmeshed with said internally threaded tunnel of said linkage structure.

9. A clamp comprising:

a first member;

a second member being adjustably engaged with said first member;

at least one of said members being defined by a pair of generally parallel sections thereof, a first interlocking snap-fit attachment fastening said pair of sections to one another, a second interlocking snap-fit attachment fastening said members to one another, said pair of sections and said members only being affixed to each other at said snap-fit attachments;

an actuating mechanism for moving said first member relative to said second member; and said first member, said second member and said actuating mechanism all being molded from a polymeric material.

10. A clamp comprising:

a first arm and a second arm being linked together for pivotable movement, a snap-fit attachment being disposed on said first arm;

an actuation mechanism having a first engagement segment and a second engagement segment;

an internally threaded linkage structure attached to one of said arms and being in incrementally adjustable association with said first engagement segment of said actuation mechanism, said second engagement segment being rotatably affixed to a preselected portion of the other of said arms, one of said arms being retractable toward and extendable away from said linkage structure upon movable adjustment of said actuation mechanism such that said pair of arms translate away from and toward one another; and said second arm having a first circular edge creating an aperture rotatably surrounding said snap-fit attachment of said first arm, said circular aperture of said second arm and said surrounded snap-fit attachment of said first arm defining a pivot;

said snap-fit attachment further including a female receptacle portion and a male portion, said female receptacle portion having a projecting wall with a substantially cylindrical shape thereof, said projecting wall further having an outer circumferential surface and an inner circumferential surface with a distal edge; and said male portion having a protruding structure with an exterior surface and a distal edge, said exterior surface being substantially cylindrical in shape, a wall of at least one of said portions having somewhat flexible and resilient properties, a flange of one of said portions interlockably engaging an undercut of the other of said portions when fully snapped together.

* * * * *

UNITED STATES PATENT AND TRADEMARK OFFICE

CERTIFICATE OF CORRECTION

PATENT NO. : 5,529,297

DATED : June 25, 1996

INVENTOR(S) : Edwin G. Sawdon

It is certified that error appears in the above-indentified patent and that said Letters Patent is hereby corrected as shown below:

Column 3, line 19, "cylindrical y-shaped" should be -- cylindrically-shaped --.

Column 4, line 24, "21 8" should be -- 218 --.

Column 4, line 57, "semicylindrical" should be -- semi-cylindrical --.

Column 5, line 62, "41 6" should be -- 416 --.

Column 6, line 1, "41 0" should be -- 410 --.

Column 6, line 52, "51 4" should be -- 514 --.

Column 6, line 64, "61 0" should be -- 610 --.

Column 7, line 67, delete "running therethrough".

Column 8, line 2, after "segment," insert -- each of --.

Column 8, line 2, after "arms" delete "each".

Column 8, line 3, after "by" delete "said" and insert -- a --.

Column 8, line 3, after "sections," insert -- and --.

Column 8, line 12, delete "therethrough".

UNITED STATES PATENT AND TRADEMARK OFFICE

CERTIFICATE OF CORRECTION

PATENT NO. : 5,529,297
DATED : June 25, 1996
INVENTOR(S) : Edwin G. Sawdon

It is certified that error appears in the above-indentified patent and that said Letters Patent is hereby corrected as shown below:

Column 8, line 13, delete "with" and insert -- , --.

Column 8, line 15, after "end" insert -- of said second arm and --.

Column 8, line 18, delete "therethrough".

Column 8, line 25, delete "therethrough".

Column 8, line 48, delete "a" and insert -- an extending --.

Column 8, line 48, delete "extending therefrom".

Column 8 , line 50, after "has" delete "a" and insert -- an inwardly projecting --.

Column 8, lines 50, 51, delete "projecting radially inward therefrom".

Column 8, line 51, delete "thereabout".

Column 8, line 55, after "a" insert -- centrally positioned --.

Column 8, lines 55, 56, delete "centrally juxtaposed therein".

Column 8, line 57, after "with" delete "a" and insert -- an extending --.

Column 8, line 58, delete "extending therefrom".

UNITED STATES PATENT AND TRADEMARK OFFICE

CERTIFICATE OF CORRECTION

PATENT NO. : 5,529,297
DATED : June 25, 1996
INVENTOR(S) : Edwin G. Sawdon

It is certified that error appears in the above-indentified patent and that said Letters Patent is hereby corrected as shown below:

Column 8, line 60, delete "therearound".

Column 9, line 6, delete "therefrom".

Column 9, line 15, delete "therein".

Column 9, line 17, after "an" insert -- extending --.

Column 9, lines 17, 18, delete "extending therefrom".

Column 9, line 18, after "an" insert -- adjacent --.

Column 9, line 19, delete "adjacent thereto".

Column 9, line 21, after "said" (second occurrence) insert -- transversely bored and --.

Column 9, line 22, delete "bored transversely therethrough".

Column 9, line 24, before "said" insert -- each of --.

Column 9, line 24, delete "each".

Column 9, line 25, after "portion," insert -- each of --.

Column 9, line 26, delete "each".

UNITED STATES PATENT AND TRADEMARK OFFICE

CERTIFICATE OF CORRECTION

PATENT NO. : 5,529,297

DATED : June 25, 1996

INVENTOR(S) : Edwin G. Sawdon

It is certified that error appears in the above-indentified patent and that said Letters Patent is hereby corrected as shown below:

Column 9, lines 29, 30, delete "thereabout".

Column 9, line 32, after "an" insert -- adjacent --.

Column 9, line 32, delete "is adjacent thereto".

Column 9, line 35, before "said" insert -- each of --.

Column 9, line 35, delete "each".

Column 9, line 36, delete "therearound".

Column 9, line 37, delete "thereon".

Column 9, line 38, delete "thereabout".

Column 9, line 39, after "an" insert -- adjacent --.

Column 9, line 40, delete "adjacent thereto".

Column 9, line 54, delete "therebetween".

Column 10, line 2, delete "therethrough".

Column 10, line 5, "pilot" should be -- pivot --.

UNITED STATES PATENT AND TRADEMARK OFFICE

CERTIFICATE OF CORRECTION

PATENT NO. : 5,529,297
DATED : June 25, 2996
INVENTOR(S) : Edwin G. Sawdon

It is certified that error appears in the above-indentified patent and that said Letters Patent is hereby corrected as shown below:

Column 10, line 33, after "plug" insert -- which are --.

Column 10, line 33, after "both" insert -- partially --.

Column 10, line 34, delete "being".

Column 10, line 34, delete "partially".

Column 10, line 35, after "engagement" insert -- by --.

Column 10, line 35, after "engagement" delete "of".

Column 10, line 39, after "having" delete "a".

Column 10, line 39, after "having" insert -- an extending --.

Column 10, line 39, delete "extending therefrom".

Column 10, lines 40, 41, delete "said cylindrical wall of said shell having".

Column 10, line 42, delete "therefrom" and insert -- from said cylindrical wall of said shell --.

Column 10, line 42, delete "with an".

UNITED STATES PATENT AND TRADEMARK OFFICE

CERTIFICATE OF CORRECTION

PATENT NO. : 5,529,297

DATED : June 25, 1996

INVENTOR(S) : Edwin G. Sawdon

It is certified that error appears in the above-indentified patent and that said Letters Patent is hereby corrected as shown below:

Column 10, line 42, after "adjacent" insert -- to an --

Column 10, line 47, delete "a" and insert -- an extending --.

Column 10, line 48, delete "extending therefrom".

Column 10, line 63, delete "therefrom".

Column 11, line 1, after "sections" insert -- , --.

Column 11, line 2, after "each" insert -- of said sections --.

Column 11, line 3, delete "therethrough".

Column 11, line 11, after "caps" insert -- , each of said pair of caps being --.

Column 11, line 13, delete "therefrom" and insert -- from said shoulder --.

Column 11, line 14, after "and" insert -- an adjacent --.

Column 11, line 14, delete "adjacent thereto".

Column 11, line 17, after "a" insert -- transversely bored and --.

Column 11, lines 17,18, delete "bored transversely therethrough".

UNITED STATES PATENT AND TRADEMARK OFFICE

CERTIFICATE OF CORRECTION

PATENT NO. : 5,529,297

DATED : June 25, 1996

INVENTOR(S) : Edwin G. Sawdon

It is certified that error appears in the above-indentified patent and that said Letters Patent is hereby corrected as shown below:

Column 11, line 19, before "said" insert -- each of --.

Column 11, line 19, delete "each".

Column 11, line 30, delete "thereof".

Column 11, line 34, after "said" insert -- first and second --.

Column 11, line 34, delete "only".

Column 11, line 35, after "other" insert -- only --.

Column 12, line 18, after "another;" delete "and".

Column 12, line 28, delete "thereof".

Signed and Sealed this

Seventh Day of January, 1997

*Attest:*

Bruce Lehman

BRUCE LEHMAN

*Attesting Officer*

*Commissioner of Patents and Trademarks*